United States Patent [19]

Kolb et al.

[11] 3,970,446

[45] July 20, 1976

[54] METHOD OF REFINING AN IRON BASE MELT

[75] Inventors: William A. Kolb, Forest Hills Borough; Jack F. Sigh, Crafton Borough, both of Pa.

[73] Assignee: United States Steel Corporation, Pittsburgh, Pa.

[22] Filed: Nov. 15, 1974

[21] Appl. No.: 524,104

Related U.S. Application Data

[60] Division of Ser. No. 309,037, Nov. 24, 1972, Pat. No. 3,897,047, which is a continuation-in-part of Ser. No. 275,848, July 27, 1972, abandoned.

[52] U.S. Cl. ..... 75/60; 75/52; 75/59

[51] Int. Cl.[2] ..... C21C 5/32; C21C 5/34

[58] Field of Search ..... 75/51, 52, 59, 60

[56] References Cited

UNITED STATES PATENTS

| | | | |
|---|---|---|---|
| 2,864,689 | 12/1958 | Perrin | 75/51 |
| 3,079,249 | 2/1963 | de Moustier | 75/52 |
| 3,771,998 | 11/1973 | Knuppel | 75/52 |

*Primary Examiner*—Peter D. Rosenberg
*Attorney, Agent, or Firm*—David S. Urey

[57] ABSTRACT

A method of oxygen refining molten hot metal to steel by blowing an oxygen stream at a predetermined flow rate from an oxygen supply source having a pressure from about 12 to about 18 atmospheres through the molten hot metal from a tuyere located beneath the surface of the molten hot metal and having a tuyere inlet and by varying the rate of flow of a finely divided lime injected into the oxygen stream is disclosed.

The method includes the steps of supplying oxygen from the oxygen supply source to the tuyere inlet at the predetermined oxygen flow rate for refining the molten hot metal; controlling the pressure of the oxygen stream at the tuyere inlet at a value which is about three atmospheres less than the difference between the pressure of the oxygen supply source and the oxygen pressure drop resulting from supplying the oxygen stream from the oxygen supply source to the tuyere inlet; injecting the finely divided lime into the oxygen stream at an injection point prior to the entry of the oxygen stream into the tuyere inlet; and increasing the pressure of the oxygen stream upstream of the injection point to maintain substantially constant the predetermined oxygen flow rate.

25 Claims, 6 Drawing Figures

(A) FROM LINE 20 FIGURE 1

(B) FROM LINE 74 FIGURE 1

(A) FROM LINE 20

(B) FROM LINE 74

(A) FROM LINE 20 FIGURE 1

(B) FROM LINE 74 FIGURE 1

(A) FROM LINE 20

(B) FROM LINE 74

METHOD OF REFINING AN IRON BASE MELT

This is a division of application Ser. No. 309,037, filed Nov. 24, 1972, now U.S. Pat. No. 3,897,047, which was a continuation-in-part application of application Ser. No. 275,848, filed July 27, 1972.

BACKGROUND OF THE INVENTION

In the manufacture of molten hot metal to steel in the Q-BOP process, oxygen is blown into the bottom of the converter or vessel during the refining of the molten hot metal to steel. When a flux, such as finely divided lime or the like, is required in the refining process, it is injected along with the oxygen through a plurality of tuyeres located in the bottom of the converter into the molten metal bath. Whenever such flux is injected into the converter, a back pressure results which decreases the oxygen flow rate. When the flux injection ceases, the back pressure is removed and the oxygen flow rate increases back to its normal or prior flow.

In the conventional operation of a Q-BOP converter, the total source oxygen pressure is applied to the tuyeres, thereby resulting in sonic flow or flow velocities greater than Mach 1.0 to the tuyere outlet. Manufacturers of such conventional process claim that this results in a better oxygen distribution in the molten metal bath and requires the minimum number of tuyeres in the bottom of the converter. The maximum oxygen flow rate attainable in the conventional system is hence fixed by the oxygen source pressure and the number and size of the tuyeres employed in the Q-BOP converter. Whenever flux is injected into the molten metal bath, the increased back pressure results in decreased oxygen flow through the tuyeres and since the oxygen source pressure cannot be increased (because full source pressure has been applied) to overcome this back pressure, the oxygen flow rate remains lower during the flux injection. However, in most cases of conventional operation, the oxygen pressure in the tuyere during the flux injection is still high enough to maintain the sonic flow of the oxygen through the tuyere outlet and to prevent the molten steel in the bath from moving downwardly through the tuyeres. Under sonic flow conditions, the oxygen flow rate varies directly as the oxygen pressure so that a drop in tuyere oxygen pressure would result in a directly proportional drop in the oxygen flow rate through the tuyeres.

An advantage of this conventional system is that the oxygen pressure at the tuyeres is maintained higher than is necessary at all times, thereby eliminating any possibility of the passage of hot molten metal from the bath into the tuyeres.

One disadvantage of the conventional system is that during the flux injection (which occurs during about 50% of the blowing time) the oxygen flow rate through the tuyeres is decreased, thereby increasing the length of blowing time required to refine the hot molten metal into steel. In order to keep the oxygen blowing rate constant during the entire blowing time, the oxygen supply pressure must be increased thereby requiring the addition of costly equipment which is not economically feasible.

We have found that the Q-BOP converter can be operated with larger and a greater number of tuyeres with oxygen flow through such tuyeres below sonic flow velocities without adverse affect on the oxygen distribution in the hot molten bath. During the flux injection period, the increased back pressure would also result in lower pressure at and decreased oxygen flow through the tuyeres. However, since the oxygen flow rate at subsonic velocities varies as the square root of the oxygen pressure changes, the oxygen flow rate per unit change in oxygen pressure is considerably less. In addition, when the Q-BOP converter is operated at subsonic oxygen velocities and at lower oxygen pressure through the tuyeres, the margin between the operating source oxygen pressure and the minimum oxygen pressure required to keep the hot molten metal out of the tuyeres during flux injection, is much less, and therefore is more critical. Since all of the source oxygen pressure has not been applied to the tuyeres, there is a reserve oxygen pressure at the oxygen pressure source which is available to preserve the margin between the required operating pressures to maintain the oxygen flow rate through the tuyeres and the minimum allowable oxygen operating pressure on the tuyeres which will keep the hot molten metal out of the tuyeres.

OBJECTS OF THE INVENTION

It is the general object of this invention to avoid and overcome the foregoing and other difficulties of and objections to prior art practices by the provision of an improved apparatus for and method of refining an iron base metal which apparatus and method:

1. operate below sonic velocities of Mach 1.0 and in the subsonic range of from about 0.7 to about 0.8 Mach 1.0 velocities;
2. will maintain the oxygen flow rate as desired through the entire blowing period including the period in which flux is injected into the hot molten metal; and
3. will prevent the transient pressure changes at the tuyeres, especially during the beginning of and the end of the flux injection into the hot molten bath from dropping to a level low enough to permit the hot molten metal from entering the tuyeres.

BRIEF SUMMARY OF THE INVENTION

The aforesaid objects of this invention and other objects which will become apparent as the description proceeds are achieved by providing an apparatus for and a method of oxygen refining molten hot metal to steel by blowing an oxygen stream at a predetermined volume rate from an oxygen supply source having a pressure from about 12 to about 18 atmospheres through the molten hot metal from a tuyere located beneath the surface of the molten hot metal and having a tuyere inlet and by varying the rate of flow of a finely divided lime injected into the oxygen stream.

The method includes the steps of supplying oxygen from the oxygen supply source to the tuyere inlet at the predetermined oxygen flow rate for refining the molten hot metal; controlling the pressure of the oxygen stream at the tuyere inlet at a value which is about three atmospheres less than the difference between the pressure of the oxygen supply source and the oxygen pressure drop resulting from supplying the oxygen stream from the oxygen supply source to the tuyere inlet; injecting the finely divided lime into the oxygen stream at an injection point prior to the entry of the oxygen stream into the tuyere inlet; and increasing the pressure of the oxygen stream upstream of the injection point to maintain substantially constant the predetermined oxygen flow rate.

Apparatus for refining the iron base melt by blowing a gas stream at a predetermined flow rate and containing a suspended particulate solid into the iron base melt through a tuyere located beneath the surface of the iron base melt and having a tuyere inlet is also disclosed.

The apparatus has a gas supply source at super atmospheric pressure; a main oxygen supply line connecting the gas supply source to the tuyere inlet for supplying the gas stream to the tuyere inlet at the predetermined flow rate for refining the iron base melt; injecton means for suspending the suspended particulate solid in the gas stream and for injecting the suspended particulate solid at a particulate injection point in the main oxygen supply line prior to entry of the gas stream and the suspended particulate solid into the tuyere inlet thereby increasing the pressure drop of the gas stream resulting from the passage of the gas stream and the suspended particulate solid through the injection means and the main oxygen supply line; flow control means in communication with the main oxygen supply line prior to the particulate injection point for sensing the flow of the gas stream; valve means connected to the flow control means and in communication with the main oxygen supply line prior to the particulate injection point for controlling the flow of the gas stream through said main oxygen supply line; and the flow control means being operable to adjust the valve means in the main oxygen supply line to maintain substantially constant the predetermined flow rate of the gas stream and the suspended particulate solid to the tuyere inlet.

BRIEF DESCRIPTION OF THE SEVERAL VIEWS OF THE DRAWINGS

For a better understanding of this invention, reference should be had to the accompanying drawings wherein like numerals of reference indicate similar parts throughout the several views and wherein.

Figure 1:
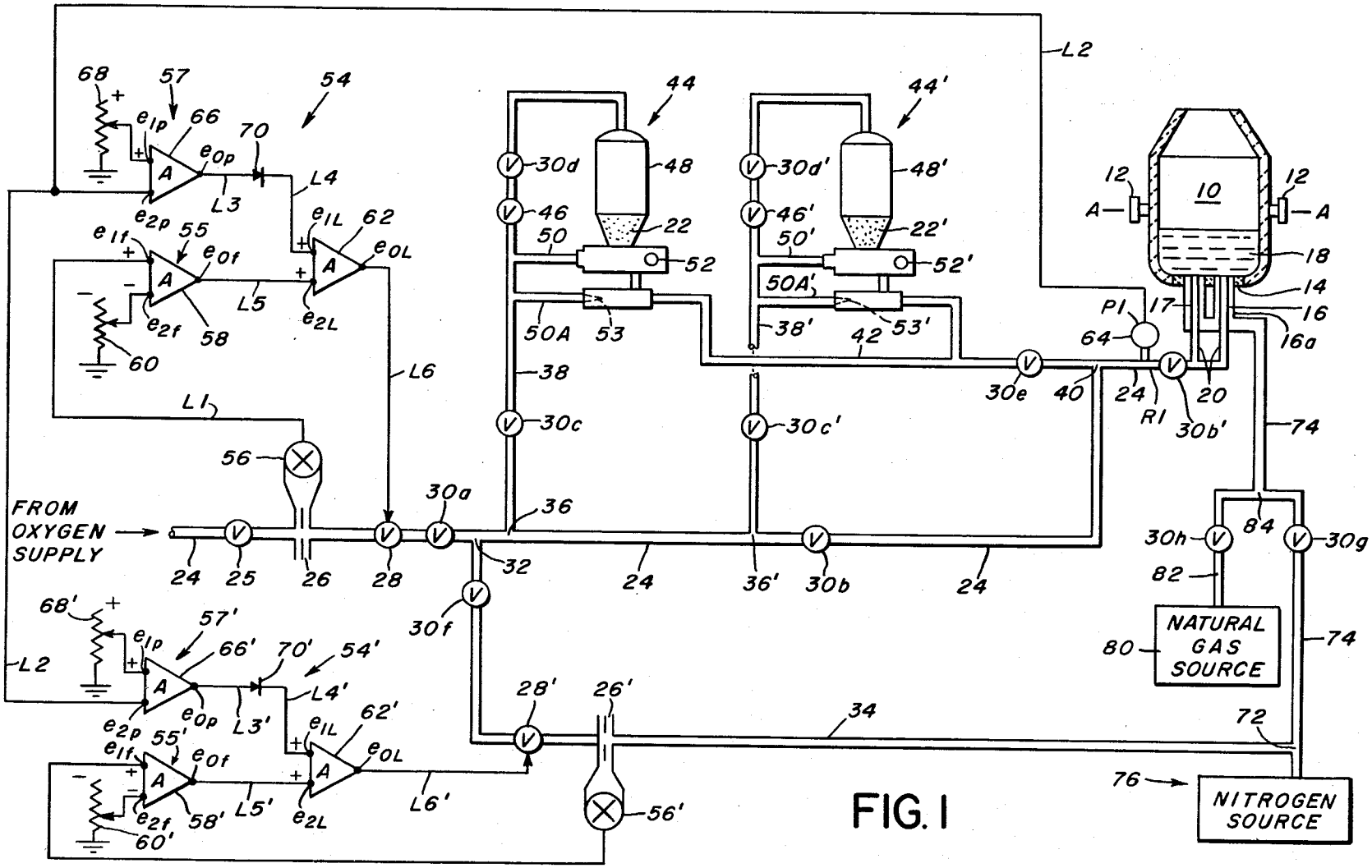
FIG. 1 is a diagrammatic view of a Q-BOP type converter and a preferred embodiment of the improved oxygen flow rate and pressure control apparatus for practicing the improved method of the present invention for refining an iron base melt into steel.

Although the principles of this invention are broadly applicable to a method of and apparatus for controlling the pressure and flow rate of a gas stream in a steel making vessel, this invention is particularly adapted for use in conjunction with a control of the flow rate and the pressure of oxygen flow through the tuyeres of a Q-BOP type converter, and hence it has been so illustrated and will be so described.

DETAILED DESCRIPTION

With specific reference to the form of this invention illustrated in the drawing, a Q-BOP type converter is indicated generally by the reference numeral 10. This Q-BOP converter 10 is rotatable about a horizontal axis A—A defined by trunnions 12 and is provided with a removable bottom plug 14 in which are mounted a plurality of tuyeres 16, each surrounded by a concentric outer pipe 16*a* which defines with each tuyere 16 a shroud fluid annulus 17.

The improved method of oxygen refining the molten hot metal 18 in the Q-BOP converter 10 to steel by blowing an oxygen stream at a predetermined flow rate R1 at each tuyere inlet 20 from an oxygen supply source indicated by the legend "FROM OXYGEN SUPPLY." The oxygen supply source has a pressure from about 12 to about 18 atmospheres. The oxygen stream is blown through the molten hot metal 18 from the tuyeres 16 located in the bottom plug 14 beneath the surface of the molten hot metal 18. The improved method also varies the rate of flow of the oxygen stream containing a suspended particulate solid, such as finely divided lime 22 or the like, injected into the oxygen stream at a particulate injection point 40 between the oxygen supply source and the tuyere inlets 20.

The oxygen flows from the oxygen supply through a main oxygen supply line 24 and thence in succession through an orifice 26, a valve means, such as a flow control valve 28 (of the type Model Mark I Pneumatic Valve manufactured by Valtek Incorporated of Provo, Utah); an isolation control valve 30*a* (of the type Model 120R manufactured by Jamesbury Corporation of Worchester, Massachusetts); a junction 32 with a branch nitrogen line 34; a junction 36 with another branch oxygen line 38; a junction 36′ with still another branch oxygen line 38′; a second isolation control valve 30*b* to the junction or particulate injection point 40 with an outlet line 42 containing the suspended lime 22 and thence through another now open control isolation valve 30*b′* to the tuyere inlets 20.

The oxygen is supplied from the oxygen supply source to the tuyere inlets 20 at the predetermined oxygen flow rate $R_1$ for refining the molten hot metal 18 into steel. The pressure of the oxygen stream at the tuyere inlet 20 is controlled during non-injection periods at a value $P_1$, which is about 3 to about 5 atmospheres less than the difference between the (about 12 to about 18 atmospheres) pressure of the oxygen supply source, and the oxygen pressure drop resulting from supplying the oxygen stream from the oxygen supply source to the tuyere inlets 20 which value $P_1$ is greater than the minimum value at which the molten metal 18 will enter the tuyeres 16. In order to inject the finely divided lime 22 into the oxygen stream at the particulate injection point 40 between the lime outlet line 42 and the oxygen supply line 24, prior to entry of such oxygen stream and suspended lime 22 into the tuyere inlets 20, a lime injection loop or loops 44,44′ are employed.

LIME INJECTION LOOPS 44,44'

During the lime injection period, the control isolation valve 30*b* is closed and the oxygen stream flows through branch lines 38,38' through now open isolation control valves 30*c*,30*c'*, check valves 46,46', now open isolation control valves 30*d*,30*d'* (of the type Model 120R manufactured by Jamesbury Corporation of Worcester, Massachusetts) into lime supply vessels 48,48' and containing the finely divided lime 22. In addition, the oxygen stream passes through branch oxygen lines 50,50' and lime injection valves 52,52' (of the special Vee knotch type ball valve manufactured by Sunnyhill Manufacturing Company of Imperial, Pennsylvania,) nozzles 53,53' fed by lines 50*a*,50*a'* and thence into the lime outlet line 42 and through a now open isolation control valve 30*e* through the particulate solid junction 40 between the lime outlet line 42 and the main oxygen supply line 24.

As a result of the back pressure due to the lime injection operation, it is necessary to increase the pressure and the flow of the oxygen stream upstream or prior to the injection point 40 to maintain substantially constant the predetermined oxygen flow rate $R_1$ and pressure $P_1$ (at the beginning and end of lime injection) through the tuyeres 16 by means of an improved oxygen flow rate and pressure control apparatus 54.

OXYGEN FLOW AND PRESSURE CONTROL DEVICE 54

In order to sense the flow rate of the oxygen stream prior to the particulate injection point 40, the device 54 has a flow control means 55. Such flow control means 55 has an oxygen flow sensing device 56 disposed across the orifice 26 for transmitting a flow signal through a line L1 to the input terminal $e_{1f}$ of a flow controller 58. The oxygen flow sensing device 56 may be of the type $E_{13}$ manufactured by Foxboro Corporation of Foxboro, Massachusetts, and the flow controller 58 may be a differential amplifier of the type P2 manufactured by Philbrick Incorporated, of Dedham, Massachusetts, which amplifier 58 performs the flow control function according to the equation:

$$e_{0p} = K\,(e_{1f} - e_{2f})$$

and where $e_{0f}$ is the output voltage, $e_{1f}$ is the voltage input from the oxygen flow sensing device 56, and $e_{2f}$ is the input voltage from a reference flow potentiometer 60. This reference potentiometer 60 provides a reference signal which represents the desired flow rate of the oxygen stream through the orifice 26 in the main oxygen supply line 24 to provide the predetermined flow rate R1 of the oxygen stream and suspended lime 22 adjacent the tuyere inlets 20.

The output signal $e_{0f}$ from the flow controller 58 is fed by line L5 to an input terminal $e_{2L}$ of a limiter 62, which limiter 62 is similar to the differential amplifier or flow controller 58. In turn, an output signal from the limiter 62 is fed from output terminal $e_{0L}$ of the limiter 62 via line L6 to the valve means or control valve 28 to cause operation of such valve 28 to control the flow of the oxygen stream through the main oxygen supply line 24.

OPERATION OF FLOW CONTROL MEANS 55

In operation, the flow sensing device 56 is a transmitter which generates an electrical signal which is proportional to the differential pressure across the orifice 26. This measured differential pressure is proportional to the oxygen flow through the orifice 26. The voltage flow signal carried via line L1 to the input terminal $e_{1f}$ of the flow controller 58 is compared, of course, to the reference voltage signal from the reference flow potentiometer 60, and applied to input terminal $e_{2f}$ of the flow controller 58. If the flow of the oxygen stream through the orifice 26 should increase, the voltage signal carried via line L1 to the input terminal $e_{1f}$ of the flow controller 58 increases, thereby causing an increase in the output voltage from output terminal $e_{0f}$ to input terminal $e_{2L}$ of the limiter 62. In turn, the voltage output from terminal $e_{0L}$ of the limiter 62 increases and is carried via line L6 to flow control valve 28 to move it to the closed position until the proper flow rate of the oxygen stream through the orifice 26 is established.

When, of course, the flow rate of the oxygen stream through the orifice 26 in the main oxygen supply line decreases, the reverse action occurs to again establish the predetermined rate of flow of oxygen through the orifice 26.

For the purpose of providing an overriding pressure control in the oxygen flow and pressure control device 54, a pressure control device 57 is provided.

PRESSURE CONTROL DEVICE 57

Such device 57 has a pressure sensing device 64 disposed in the main oxygen supply line 24 just prior to the tuyere inlets 20. This pressure sensing device 64 is of the type Model E11GM manufactured by Foxboro Corporation of Foxboro, Massachusetts and sends a voltage signal via line L2 to an input terminal $e_{2p}$ of a pressure controller 66.

The pressure controller 66 is a differential amplifier which is similar to the flow controller 58 and the limiter 62. A pressure reference potentiometer 68 applies a reference pressure signal representing the desired pressure P1 of the oxygen stream at the tuyere inlets 20 to an input terminal $e_{1p}$ of the pressure controller 66. The output signal from terminal $e_{0p}$ of the pressure controller 66 is fed via line L3 through a blocking device, such as the diode 70 or the like. This blocking diode 70 is employed to permit the passage of only a positive output voltage from output terminal $e_{0p}$ of the pressure controller 66 to reach the input terminal $e_{1L}$ of the limiter 62 via line L4 between the diode 70 and the limiter 62.

OPERATION OF PRESSURE CONTROL DEVICE 57

If the voltage signal from the pressure sensor 64 to the input terminal $e_{2p}$ of the pressure controller 66 is higher than the reference signal from the reference potentiometer 68 to the input terminal $e_{1p}$ of the pressure controller 64, the pressure controller 66 provides a negative output signal from its output terminal $e_{0p}$ via line L3 to the blocking diode 70. But since the blocking diode 70 will, of course, transmit only a positive signal from the pressure controller 66 to the limiter 62, this negative output signal from terminal $e_{0p}$ is blocked by the diode 70 and thereby prevented from adjusting the control valve 28 through the limiter 62.

If the pressure signal via line L2 from the pressure sensor 64 to input terminal $e_{2p}$ of the pressure controller 66 is less than the reference pressure signal from the pressure reference potentiometer 68 to input terminal $e_{1p}$ of the pressure controller 66, positive output signal from output terminal $e_{0p}$ of the pressure controller 66 passes through the diode 70 to the input terminal $e_{1L}$ of the limiter 62 via line L4. Since the flow voltage signal fed from output terminal $e_{of}$ of the flow controller 56 via line L5 to input terminal $e_{2L}$ is always positive and this input voltage from output terminal $e_{0p}$ of the pressure controller 66 to input terminal $e_{1L}$ of the limiter 62 is positive, a decreased output limiter voltage from output terminal $e_{oL}$ of the limiter 62 via line L6 to the flow control valve 28 causes the control valve 28 to open with attendant increased flow of oxygen through the main oxygen supply line 24.

In summary, oxygen flow and pressure control device 54 functions to:

1. control the flow of the oxygen stream to the tuyere inlets 20 at all times and to maintain such oxygen flow rate to the tuyere inlets 20 at a predetermined flow rate R1 set by the reference flow set point on flow reference potentiometer 60;

2. provide a pressure control override which allows the oxygen flow and pressure control apparatus 54 to increase the oxygen flow to the tuyere inlets 20 at all times, but in the event that the rate of flow of the oxygen stream should decrease the pressure P1 at the tuyere inlets 20 to a point where it permits the introduction of molten hot metal 18 into the tuyeres 16, (i.e., a minimum operating pressure P1 set by the pressure reference set point on the pressure reference potentiometer 68), the apparatus 54 automatically increases the flow and hence the pressure of the oxygen stream at the tuyere inlets 20 above such minimum value P1; and 3. prevent the transient pressure changes at the tuyeres 16, especially during the beginning of and the end of the flux injection into the hot molten bath 18 from dropping to a level low enough to permit the hot molten metal 18 from entering the tuyeres 16.

EXAMPLES

Examples of the flow and pressure control apparatus 54 are shown in Table I on the following page.

from a nitrogen source 76 through a control isolation valve 30g to the shroud gas pipe 16a, concentric with the tuyeres 16.

When valves 30a, 30c, 30c', 30e are closed and valves 30f, 30b, and 30b' are open, nitrogen flows through lines 34, 24 to the tuyere inlets 20.

In the case where the nitrogen gas is shut off by means of the control isolation valve 30g, natural gas or the like flows from a natural gas source 80 through a control isolation valve 30h in a branch line 82 to a junction 84 with the line 74 and thence through the line 74 to the shroud gas pipes 78.

ALTERNATIVE EMBODIMENTS

It will be understood by those skilled in the art that the oxygen flow and pressure control apparatus 54' may also be utilized in conjunction with another orifice 28 and flow control valve 28' and oxygen flow sensing device 56' to control the flow and pressure of nitrogen through lines 34, 24 to the tuyeres.

Figures 1, 2:
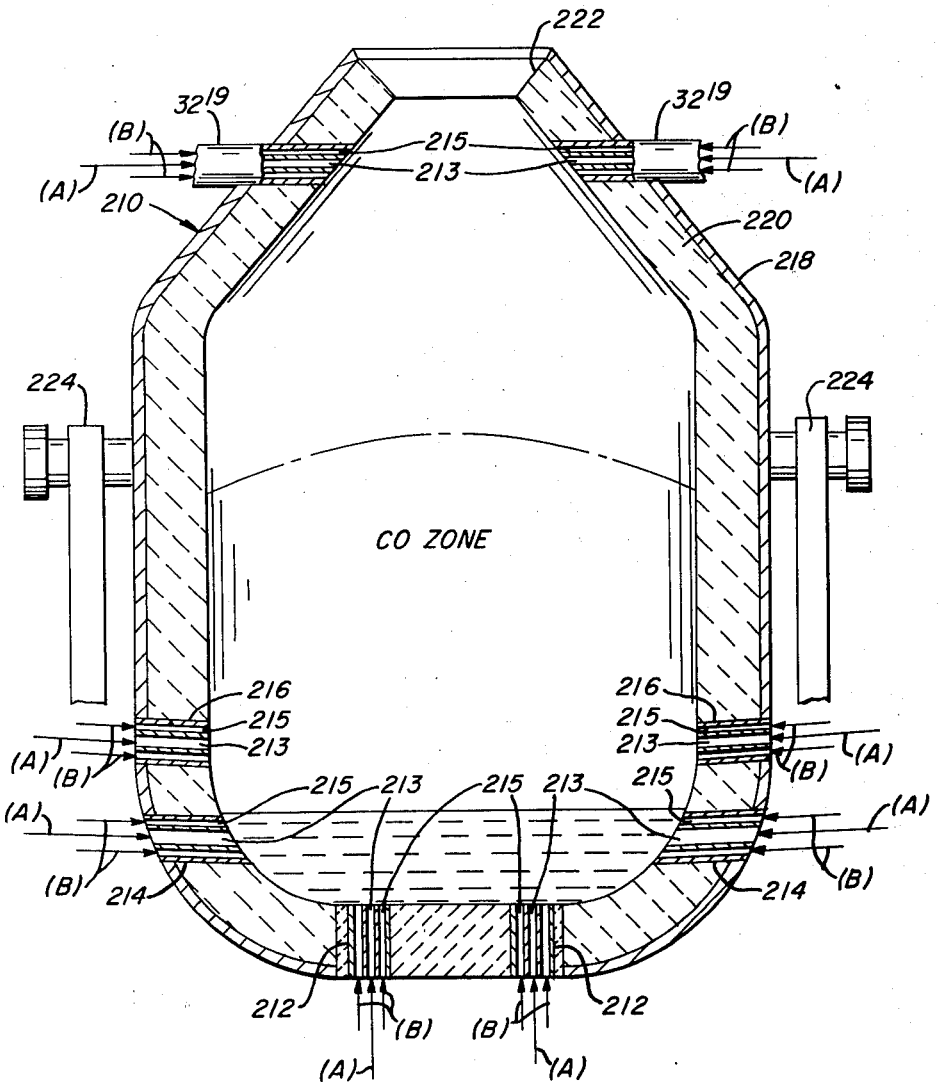
FIG. 2 is a vertical sectional view of a bottom blown oxygen converter showing a pair of submerged bottom tuyeres, a pair of side submerged tuyeres, and a pair of side tuyeres directed toward the carbon monoxide zone of the furnace.

From a consideration of FIG. 2, it will be apparent that the present invention may be employed with a bottom blown converter 210 having bottom submerged tuyeres 212, the side submerged tuyeres 214 and side tuyeres 216 directed toward the carbon monoxide zone (CO zone) of the converter 210. This bottom blown converter 210 has a shell 218 provide with a refractory lining 220 and a mouth 222 and is rotatable on trunnions 224. The tuyeres 212, 214, 216 are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), or a blocking or deoxidizing agent (ferro manganese or the like), and in an outer pipe 215 a shroud gas, such as propane, natural gas, light fuel oil or the like.

Figure 3:
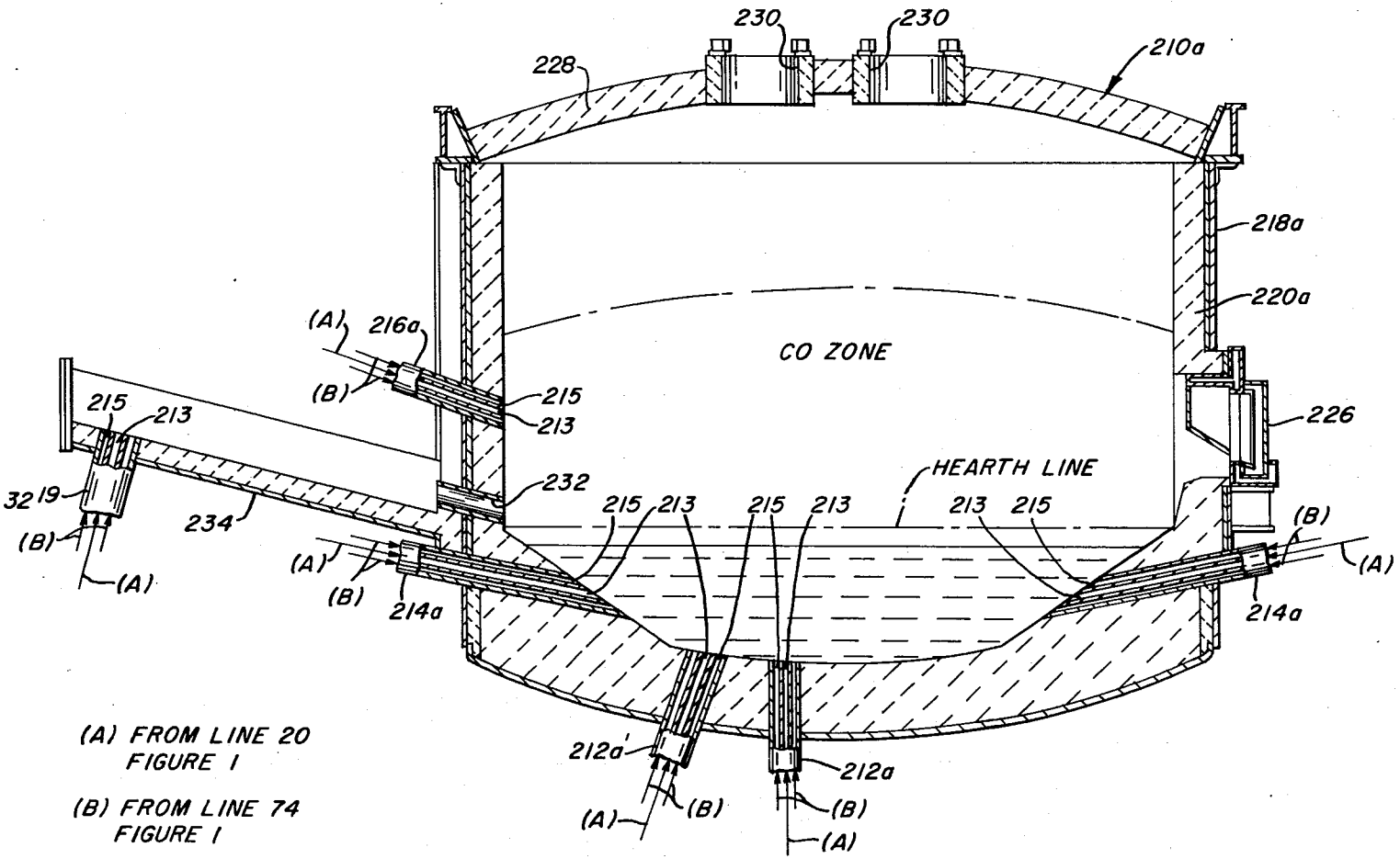
FIG. 3 is a vertical sectional view of an electric-arc steelmaking furnace showing a bottom vertical and bottom inclined submerged tuyere, a pair of side submerged tuyeres and a side tuyere directed toward the carbon monoxide zone of the furnace.

As shown in FIG. 3, the present invention is also applicable to a Heroult Type electric-arc steelmaking furnace 210a provided with a vertical and inclined

TABLE I

| Conditions | Tuyers Pressure P1 Referred to Setpoint on Reference Pot. 68 | Output of Device Pressure Controlled 66 at $e_{op}$ (Volts) | Out Signal From Device 70 (Diode) to $e_u$ (Volts) | Flow Referred to Setpoint on Reference Pot. 60 | Output of Flow Controller 58 on volts are of (Always Positive) | Output of Limiter 62 at $e_{oL}$ (Volts) | Controlling Variable | Position of Valve 28 |
|---|---|---|---|---|---|---|---|---|
| 1* | Higher | — | 0 | Equal | + some value | + some value | flow | Open to some value |
| 2 | Higher | — | 0 | Lower | Decreases | Decreases | flow | Valve opens |
| 3 | Higher | — | 0 | Higher | Increase | Increases | flow | Valve closes |
| 4 | Higher | — | 0 | Very High | Increases | Increase until a signal is received by diode 70 then stops | flow then pressure | Valve closes to pressure limit and stops |
| 5 | Equal | 0 | 0 | High | Increases | " | flow then pressure but shorter time than 4 above | Valve closes to pressure limit stops but in shorter time than 4 above |
| 6 | Lower | + | + | High | Increases | Decreases | Pressure | Valve opens |

Examples of Setpoint
P1 = Pressure from about 3 to 4 atmospheres
R1 = Flow of about 3000 scfm of $O_2$

*In condition No. 1, all requirements satisfied

The hereinbefore mentioned nitrogen branch line 34 extends from its junction 32 from the main oxygen supply line 24 through a control isolation valve 30f to a junction 72 with a nitrogen supply line 74 extending bottom submerged tuyere 212a and 212a', side submerged tuyeres 214a, and a side tuyere 216a directed toward the carbon monoxide zone (CO zone) of the furnace 210a. This electric arc steelmaking furnace 210*a* has a shell 218*a* provided with a refractory lining 220*a*, a side door 226, a refractory roof 228 provided with electrode holes 230, a tap hole 232, and a pouring spout 234 extending from the tap hole 232. The tuyeres 212 and 212*a*', 214*a*, 216*a* are adapted to carry in an inner pipe 213 either a fluid alone, such as oxygen, air, argon, or mixtures thereof, or entrained pulverized additives therein, such as a fluxing agent (burned lime (CaO) or the like), a liquefying agent, (fluorspar ($CaF_2$) or the like), or a blocking or deoxidizing agent (ferro manganese or the like), and in an outer pipe 215, a shroud gas, such as propane, natural gas, light fuel oil or the like.

Figure 4:
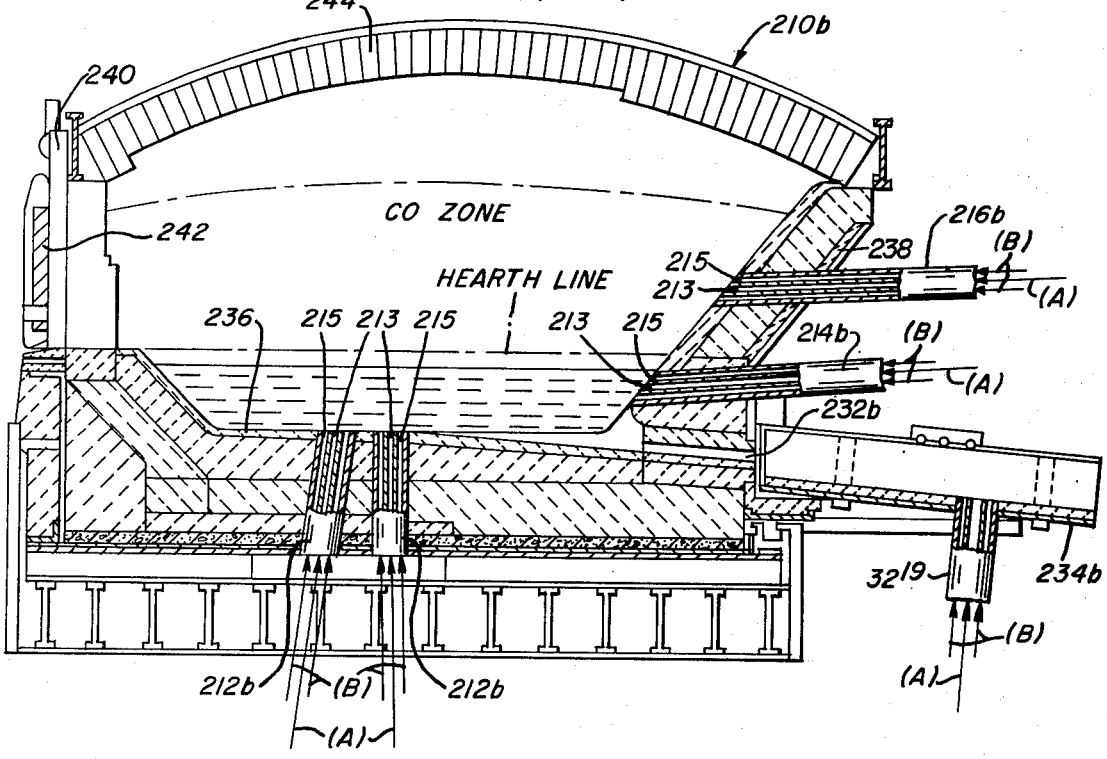
FIG. 4 is a vertical sectional view of an open hearth furnace utilizing a vertical and inclined bottom submerged tuyere, a side submerged tuyere and another side tuyere directed toward the carbon monoxide zone of the furnace.

In addition, the present invention may be employed as shown in FIG. 4 with the open hearth furnace 210*b* having the vertical and inclined bottom submerged tuyeres 212*b* and 212*b*', the side submerged tuyere 214*b*, and the side tuyere 216*b* directed toward the carbon monoxide zone (CO zone) of the furnace 210*b*. This open hearth furnace 210*b* includes a refractory lined bottom 236, a refractory lined sloping back wall 238, a refractory lined front wall 240, a charging door 242 in the wall 240, and a refractory lined roof 244. A tap hole 232*b* opposite the charging door 242 leads to a pouring spout 234*b*. The tuyeres 212*b*, 212*b*', 214*b*, 216*b* are adapted to carry in an inner pipe 213 either a fluid alone, such as oxygen, air, argon, or mixtures thereof, or entrained pulverized additives therein, such as a fluxing agent (burned line (CaO) or the like), a liquefying agent (fluorspar ($CaF_2$) or the like), or a blocking or deoxidizing agent (ferro manganese or the like) and in an outer pipe 215, a shroud gas, such as propane, natural gas, light fuel oil or the like.

Figure 5:
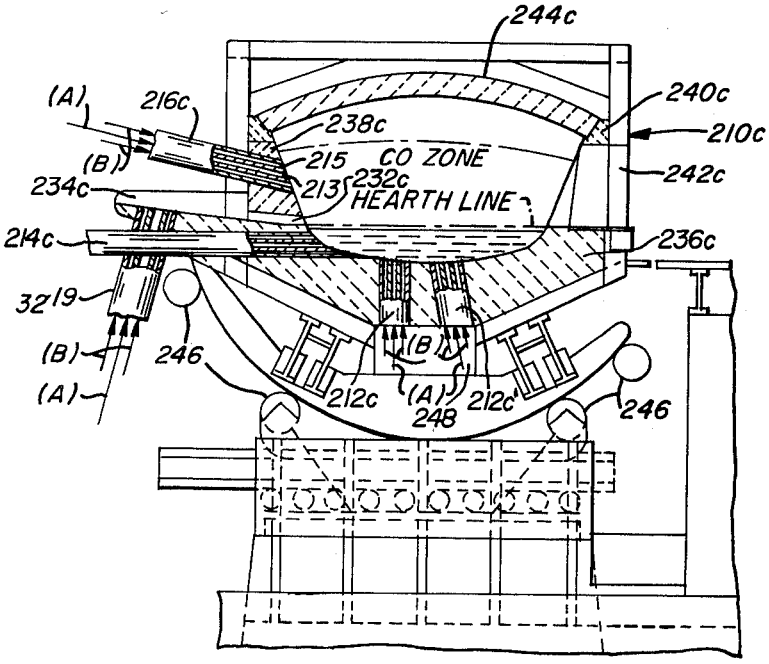
FIG. 5 is a vertical sectional view of a tiltable open hearth furnace having a vertical and an inclined bottom submerged tuyere, a side submerged tuyere and side tuyere directed toward the carbon monoxide zone of the furnace.

Again as shown in FIG. 5, the present invention may be employed with a tilting open hearth furnace 210*c* mounted on rollers 246 arranged in a circular path for providing rotation on the longitudinal axis of the furnace 210*c* for pouring the refined steel through a tap hole 232*c* and a pouring spout 234*c*. As shown in FIG. 5, the tiltable open hearth furnace 210*c* has vertical and inclined bottom submerged tuyeres 212*c* and 212*c*' connected through a blast box 248 to the lines 20 and 74 shown in FIG. 1. In addition, a submerged side tuyere 214*c* and a side tuyere 216*c* directed toward the carbon monoxide zone (CO zone) of the furnace 210*c* are employed. The tiltable open hearth furnace 210*c* has a refractory lined bottom 236*c*, refractory lined back wall 238*c*, refractory lined front wall 240*c* (provided with a charging door 242*c*) and a refractory lined roof 244*c*. The tuyeres 212*c*, 212*c*', 214*c*, 216*c* are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), or a blocking or deoxidizing agent (ferro manganese or the like), and in an outer pipe 215, a shroud gas, such as propane, natural gas, light fuel oil or the like.

Figures 1, 6:
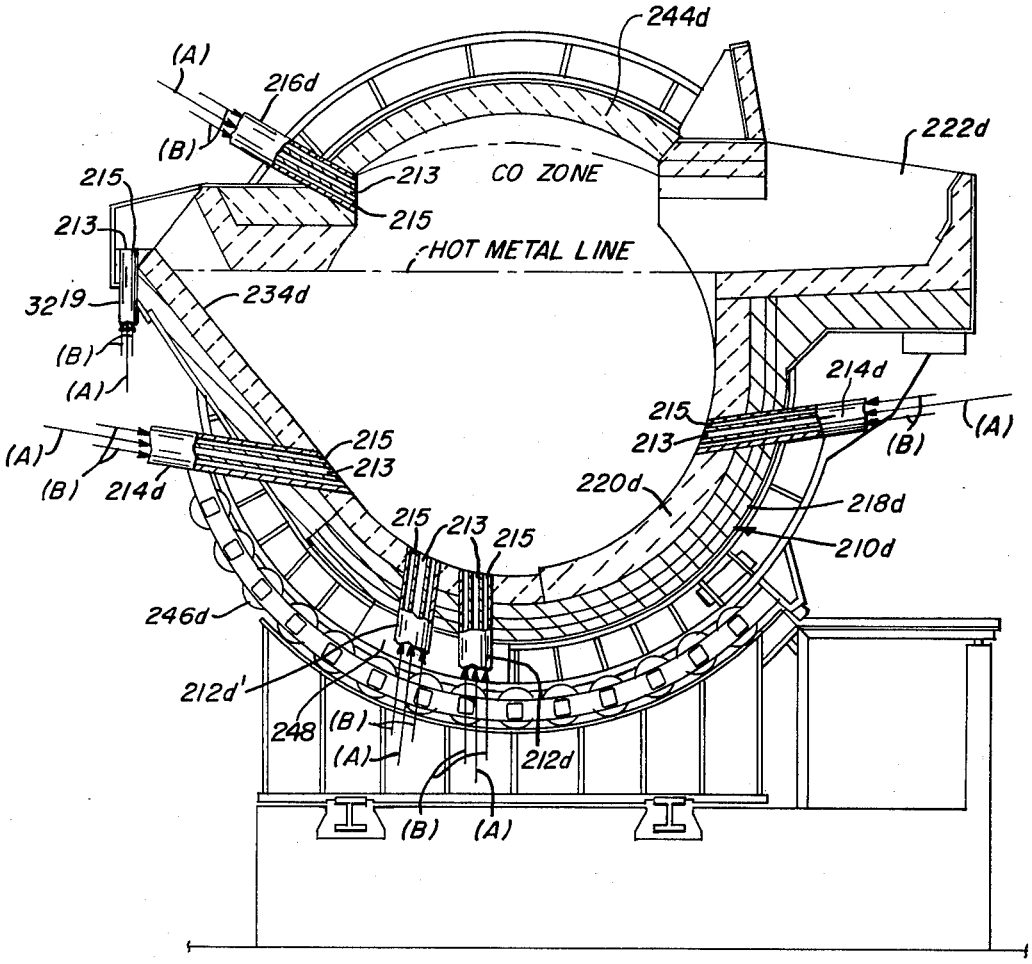
FIG. 6 is a vertical sectional view of oscillatable hot metal mixer having an inclined bottom and vertical bottom submerged tuyeres, a pair of side submerged tuyeres and a side tuyere directed toward the carbon monoxide zone of the mixer.

In FIG. 6, the present invention is employed with a hot metal mixer 210*d* having a shell 218*d* provided with a refractory lining 220*d*, and having also an inlet mouth 222*d* and a pouring spout 234*d*. The mixer 210*d* is oscillatable on rollers 246*d* between the charging and discharging positions. Such mixer 210*d* has vertical and inclined bottom submerged tuyere 212*d*,212*d*', side submerged tuyeres 214*d*, and side tuyere 216*d* directed toward the carbon monoxide zone (CO zone) of the mixer 210*d*. The tuyeres 212*d*, 212*d*',214*d*, 216*d*, are adapted to carry in an inner pipe 213 either a fluid alone, such as oxygen, air, argon, or mixtures thereof, or entrained pulverized additives therin, such as a fluxing agent (burned lime (CaO) or the like), a liquefying agent (Fluorspar ($CaF_2$) or the like), or a blocking or deoxidizing agent (ferro manganese or the like), and in an outer pipe 215, a shroud gas, such as propane, natural gas, light fuel oil or the like.

A discharge tuyere or tuyeres $32^{19}$ (FIGS. 2,3,4,5,6) is disposed adjacent a discharge opening such as the mouth 222 (FIG. 2); the pouring spouts 234 (FIG. 3); 234*b* (FIG. 4); 234*c* (FIG. 5); and 234*d* (FIG. 6) to prevent the formation of skulls adjacent or on the discharge opening during the pouring operation particularly those chromium-nickel skulls produced during the refining of stainless steel.

METHOD

It will be understood by those skilled in the art from the above description of the oxygen flow control means 55 of the oxygen flow and pressure control apparatus 54 that an improved method of oxygen refining molten hot metal to steel is contemplated. This method includes the steps of:

a. supplying oxygen from the oxygen supply source (identified by the legend "OXYGEN SUPPLY") via the main oxygen supply line 24 to the tuyere inlets 20 at a predetermined oxygen flow rate $R_1$ for refining the molten hot metal 18;

b. controlling (by means of the pressure sensing device 64, the pressure controller 66, the blocking diode 70, the limiter 62 and the flow control valve 28) the pressure of the oxygen stream at the tuyere inlets 20 at a value $P_1$, which pressure is about 3 atmospheres less than the difference between the about 12–18 atmospheres pressure of the oxygen supply source and the oxygen pressure drop $P_D$ resulting from supplying the oxygen stream from the oxygen supply source via the main oxygen supply line 24 to the tuyere inlets 20;

c. injecting the finely divided lime 22 via branch lines 38,50 the lime supply vessels 48,48', lime injection valves 52,52' and lime outlet line 42 into the oxygen stream at an injection point 40 prior to the entry of the oxygen stream into the tuyere inlets 20;

d. increasing the pressure of the oxygen stream upstream of the injection point 40 to maintain substantially constant the predetermined oxygen flow rate $R_1$ at the inlets 20 of the tuyeres 16.

In addition, the method includes the steps of:

a. sensing by means of the flow sensing device 56 the flow rate of the oxygen stream at the orifice 26 prior to the particulate injection point 40 to create a flow signal;

b. applying the flow signal via line L1 to input terminal $e_{1f}$ of the flow controller 58;

c. comparing this flow signal at the flow controller 58 with a reference flow signal representing the desired flow rate $R_1$ of the oxygen stream and applied to the flow controller 58 at input terminal $e_{2f}$;

d. applying an output flow signal from output terminal $e_{0f}$ of the flow controller 58 to a flow limiter 62; and e. applying an output flow signal from output terminal $e_{0L}$ of the flow limiter 62 via line L6 to a valve means or control valve 28 to adjust such valve 28 to permit the passage of the desired flow rate of the oxygen stream through the control valve 28.

In addition, the pressure override portion 57 of the oxygen flow and pressure control apparatus 54 includes in the improved method the additional steps of:

a. sensing by the pressure sensor 64 the pressure of the oxygen stream adjacent the tuyere inlets 20 to create a pressure signal;

b. applying the pressure signal via line 12 to the input terminal $e_{2p}$ of the pressure controller 66;

c. comparing the pressure signal at the input terminal $e_{2p}$ of the pressue controller 66 with a reference pressure signal representing the desired pressure P1 of the oxygen stream at the tuyere inlets 20 and applied to the input terminal $e_{1p}$ of the pressure controller 66;

d. applying an output signal from output terminal $e_{0p}$ of the pressure controller 66 to the flow limiter 62; and e. applying an output signal from output terminal $e_{0l}$ of the flow limiter 62 to the control valve 28 to adjust the control valve 28 to permit a flow rate of the oxygen stream through the flow control valve 28 which will produce the desired pressure P1 of the oxygen stream of the tuyere inlets 20.

In addition, the improved method also includes the additional step of:

a. blocking by means of a blocking device 70 the output signal of the output terminal $e_{0p}$ of the pressure controller 66 to the input terminal $e_{1L}$ of the flow limiter 62 when the pressure of the oxygen stream at the tuyere inlets 20 is greater than the desired pressure P1 of the oxygen stream at such tuyere inlets 20.

SUMMARY OF THE ACHIEVEMENTS OF THE OBJECTS OF THE INVENTION

It will be recognized by those skilled in the art that the objects of this invention have been achieved by providing an improved method of and apparatus for refining a molten hot metal to steel, which method:

a. operates below sonic velocities (Mach 1.0) and in a subsonic range near 0.7–0.8 of Mach 1.0 velocity);

b. will maintain the oxygen flow rate $R_1$ constant throughout the blowing period and in particular, during the fluxing period when finely divided lime 22 is being injected through the tuyeres 16 and in addition, when such lime is not being injected into such tuyeres 16; and c. will prevent transient pressure changes at tuyere inlets 20 particularly during the starting and stopping of flux injection from dropping below a minimum pressure level P1 thereby preventing the molten hot metal 18 from entering the tuyeres 16.

While in accordance with the patent statutes, a preferred and alternative embodiment of this invention has been illustrated and described in detail, it is to be particularly understood that the invention is not limited thereto or thereby.

We claim:

1. A method of refining an iron base melt by blowing a gas stream at a predetermined flow rate and containing a suspended particulate solid into said iron base melt through a tuyere located beneath the surface of said iron base melt and having a tuyere inlet, said method including the steps of:

a. supplying said gas stream from a gas supply source at super atmospheric pressure through a closed supply system to said tuyere inlet at said predetermined flow rate for refining said iron-base melt;

b. maintaining the pressure of said gas stream so that the pressure of said gas stream at said tuyere inlet is less than the difference between said super atmospheric pressure of said gas supply source and the pressure drop in said gas stream resulting from the passage of said gas stream through said closed supply system;

c. injecting said suspended particulate solid into and suspending said suspended particulate solid in said gas stream at a particulate injection point in said closed supply system prior to entry of said gas stream into said tuyere inlet thereby increasing said pressure drop of said gas stream from said gas supply source to said tuyere inlet as a result of the passage of said gas stream and said suspended particulate solid through said closed supply system; and d. increasing the pressure of said gas stream upstream of said particulate injection point to counteract said pressure drop in said closed supply system due to the injection and transport of said suspended particulae solid and thereby maintaining substantially constant said predetermined flow rate to said tuyere inlet.

2. A method of oxygen refining molten hot metal to steel by blowing an oxygen stream at a predetermined flow rate from an oxygen supply source having a pressure from about 12 to about 18 atmospheres through said molten hot metal from a tuyere located beneath the surface of said molten hot metal and having a tuyere inlet and by varying the rate of flow of a finely divided lime injected into said oxygen stream, said method including the steps of:

a. supplying oxygen from an oxygen supply source to said tuyere inlet at said predetermined oxygen flow rate for refining said molten hot metal;

b. controlling the pressure of said oxygen stream at said tuyere inlet at a value which is from about three atmospheres to about five atmospheres less than the difference between the pressure of said oxygen supply source and the oxygen pressure drop resulting from supplying said oxygen stream from said oxygen supply source to said tuyere inlet;

c. injecting said finely divided lime into said oxygen stream at an injection point prior to entry of said oxygen stream into said tuyere inlet; and d. increasing the pressure of said oxygen stream upstream of said injection point to maintain substantially constant said predetermined oxygen flow rate.

3. The method recited in claim 1 including the steps of:

a. sensing the flow rate of said gas stream prior to said particulate injection point to create a flow signal; and b. applying said flow signal to a flow controller.

4. The method recited in claim 3 including the steps of:

a. comparing said flow signal at said flow controller with a reference flow signal representing the desired flow rate of said gas stream and applied to said flow controller;

b. supplying an output flow signal from said flow controller to a flow limiter; and c. applying an output flow signal from said flow limiter to a valve means to adjust said valve means to permit the passage of the desired flow rate of said gas stream through said valve means.

5. The method recited in claim 1 including the steps of:

a. sensing the pressure of said gas stream adjacent said tuyere inlet to create a pressure signal; and b. applying said pressure signal to a pressure controller.

6. The method recited in claim 5 including the steps of:

a. comparing said pressure signal at said pressure controller with a reference pressure signal representing the desired pressure of said gas stream at said tuyere inlet and applied to said pressure controller, which desired pressure prevents said iron base melt from entering said tuyere;

b. applying an output signal from said pressure controller to a flow limiter; and c. applying an output signal from said flow limiter to a valve means to adjust said valve means to permit a flow rate of said gas stream through said valve means which will produce the desired pressure of said gas stream at said tuyere inlet.

7. The method recited in claim 6 including the step of:

a. blocking said output signal from said pressure controller to said flow limiter when the pressure of said gas stream at said tuyere inlet is greater than said desired pressure of said gas stream at said tuyere inlet.

8. The method recited in claim 4 including the steps of:

a. sensing the pressure of said gas stream adjacent said tuyere inlet to create a pressure signal;

b. applying said pressure signal to a pressure controller.

9. The method recited in claim 8 including the steps of:

a. comparing said pressure signal at said pressure controller with a reference pressure signal representing the desired pressure of said gas stream at said tuyere inlet and applied to said pressure controller;

b. applying an output signal from said pressure controller to said flow limiter; and c. applying an output signal from said flow limiter to said valve means to adjust said valve means to permit a flow rate of said gas stream through said valve means which will produce the desired pressure of said gas stream at said tuyere inlet.

10. The method recited in claim 9 including the step of:

a. blocking said output signal from said pressure controller to said flow limiter when the pressure of said gas stream at said tuyere inlet is greater than said desired pressure of said gas stream at said tuyere inlet.

11. The method recited in claim 2 including the steps of:

a. sensing the flow rate of said oxygen stream prior to said injection point to create a flow signal; and b. applying said flow signal to a flow controller.

12. The method recited in claim 11 including the steps of:

a. comparing said flow signal at said flow controller with a reference flow signal representing the desired flow rate of said oxygen stream and applied to said flow controller;

b. applying an output flow signal from said flow controller to a flow limiter; and c. applying an output flow signal from said flow limiter to valve means to adjust said valve means to permit the passage of the desired flow rate of said oxygen stream through said valve means.

13. The method recited in claim 2 including the steps of:

a. sensing the pressure of said oxygen stream adjacent said tuyere inlet to create a pressure signal; and b. applying said pressure signal to a pressure controller.

14. The method recited in claim 13 including the steps of:

a. comparing said pressure signal at said pressure controller with a reference pressure signal representing the desired pressure of said oxygen stream at said tuyere inlet and applied to said pressure controller which desired pressure prevents said molten hot metal from entering the tuyere;

b. applying an output signal from said pressure controller to a flow limiter; and c. applying an output signal from said flow limiter to a valve means to adjust said valve means to permit a flow rate of said oxygen stream through said valve means which will produce the desired pressure of said oxygen stream at said tuyere inlet.

15. The method recited in claim 14 including the step of:

a. blocking said output signal from said pressure controller to said flow limiter when the pressure of said oxygen stream at said tuyere inlet is greater than said desired pressure of said oxygen stream at said tuyere inlet.

16. The method recited in claim 12 including the steps of:

a. sensing the pressure of said oxygen stream adjacent said tuyere inlet to create a pressure signal; and b. applying said pressure signal to a pressure controller.

17. The method recited in claim 16 including the step of:

a. comparing said pressure signal at said pressure controller with a reference pressure signal representing the desired pressure of said oxygen stream at said tuyere inlet and applied to said pressure controller;

b. applying an output from said pressure controller to said flow limiter; and c. applying an output signal from said flow limiter to said valve means to adjust said valve means to permit a flow rate of said oxygen stream through said valve means which will produce the desired pressure of said oxygen stream at said tuyere inlet.

18. The method recited in claim 17 including the step of:

a. blocking said output signal from said pressure controller to said flow limiter when the pressure of said oxygen stream at said tuyere inlet is greater than said desired pressure of said oxygen stream at said tuyere inlet.

19. The method recited in claim 1 including the step of:

a. supplying said gas stream from said gas supply source at super atmospheric pressure through said closed supply system to said tuyere inlet at said predetermined flow rate for refining said iron base melt and at a flow velocity of between about 0.7 and about 0.8 of Mach 1.0.

20. The method recited in claim 2 including the step of:

a. supplying oxygen from said oxygen supply source to said tuyere inlet at said predetermined oxygen flow rate for refining said molten hot metal and at a flow velocity of about 0.7 to about 0.8 of Mach 1.0.

21. The method recited in claim 1 wherein said tuyere is a bottom submerged tuyere.

22. The method recited in claim 1 wherein said tuyere is a submerged side tuyere.

23. The method recited in claim 1 wherein said side tuyere is directed toward a carbon monoxide zone above said iron base melt.

24. The method recited in claim 1 wherein said tuyere is a tuyere disposed adjacent a discharge opening to prevent the formation of skulls adjacent said pour opening during pouring of said molten metal.

25. A method of refining a molten steel bath in a vessel, said vessel having at least one tuyere mounted in the bottom area thereof below the level of the bath, said tuyere having an inner tube through which oxygen is injected into said bath, and a concentric outer tube forming an annulus with said inner tube through which a hydrocarbon fluid is injected into said bath for cooling said tuyere, the method comprising the steps of:

providing a supply source of oxygen at a pressure of 12 to 18 atmospheres;

reducing the pressure of said oxygen by approximately 3 to 5 atmospheres at a point intermediate said supply source and said tuyere;

supplying said oxygen through a closed piping system to said tuyere at a subsonic velocity;

supplying said hydrocarbon to the annulus of said tuyere for cooling said tuyere;

periodically injecting finely divided particulate lime into the oxygen in said closed piping system and thereby injecting the lime into the bath through the tuyere with the oxygen; and increasing the pressure of said oxygen during said periods of particulate injection by an amount in the range of 3 to 5 atmospheres which is equal to the additional pressure drop caused by said particulate injection so that the flow of said oxygen through said tuyere remains substantially constant during both periods of particulate injection and non-injection.

* * * * *